US011004429B2

(12) United States Patent
Johnson

(10) Patent No.: US 11,004,429 B2
(45) Date of Patent: May 11, 2021

(54) ACOUSTIC BASS GUITAR

(71) Applicant: Troy Johnson, Omaha, NE (US)

(72) Inventor: Troy Johnson, Omaha, NE (US)

( * ) Notice: Subject to any disclaimer, the term of this patent is extended or adjusted under 35 U.S.C. 154(b) by 0 days.

(21) Appl. No.: 16/814,109

(22) Filed: Mar. 10, 2020

(65) Prior Publication Data

US 2020/0211514 A1 Jul. 2, 2020

Related U.S. Application Data

(60) Provisional application No. 62/855,353, filed on May 31, 2019.

(51) Int. Cl.
*G10D 3/06* (2020.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 3/06; G10D 1/08; G10D 1/02
See application file for complete search history.

(56) References Cited

U.S. PATENT DOCUMENTS 474,120 A * 5/1892 Ganss ..... G10D 1/08 84/267
497,939 A * 5/1893 Abelspies ..... G10D 1/08 84/263
518,775 A * 4/1894 Birrer ..... G10D 1/08 84/267
552,116 A * 12/1895 Gaskins ..... G10D 1/08 84/267
D28,300 S * 2/1898 Knutsen ..... D17/18
668,060 A * 2/1901 Shelton ..... G10D 3/06 84/263
812,049 A * 2/1906 Krueger ..... G10D 1/08 84/267
1,183,369 A * 5/1916 Gardie ..... G10D 1/08 84/263
D50,545 S * 3/1917 Vaughn ..... D17/19
1,733,595 A * 10/1929 Greenfield ..... G10D 1/08 84/267
1,758,626 A * 5/1930 Haberman ..... G10D 1/08 84/319
1,789,681 A * 1/1931 Haberman ..... G10D 1/08 84/319
1,834,804 A * 12/1931 Puoina ..... G10D 1/08 84/267

(Continued)

*Primary Examiner* — Robert W Horn
(74) *Attorney, Agent, or Firm* — Boudwin Intellectual Property; Daniel Boudwin

(57) ABSTRACT

An acoustic bass guitar includes a lower body, a neck extending upwardly from the lower body, and a headstock disposed on an upper end of the neck. The lower body includes a bridge and saddle to support the strings, which are affixed at opposing ends to tuners on the headstock. An upper body that is continuous with the lower body includes a curved extension that extends outwardly from an upper side of the lower body. The upper body curves inwardly toward the upper end of the neck, connecting to the headstock and defining an open area between the neck and the inner sidewall of the upper body. One or more sound holes are disposed on the front face and outer sidewall of the upper body. A retractable stand allows the device to be played in horizontal or vertical orientations. The curved upper body adds neck stability, sound and sustain.

18 Claims, 3 Drawing Sheets

(56) References Cited

U.S. PATENT DOCUMENTS 2,250,402 A 7/1941 Towell
3,418,876 A * 12/1968 Dopyera ..... G10D 3/06 84/293
4,078,468 A * 3/1978 Civitello ..... G10D 1/02 84/274
4,359,924 A * 11/1982 Brunet ..... G10D 3/06 84/293
4,606,255 A * 8/1986 Hayashi ..... G10H 3/18 84/267
4,616,550 A * 10/1986 Lacroix ..... G10D 3/06 84/173
5,025,695 A * 6/1991 Viel ..... G10D 3/06 84/293
5,072,643 A * 12/1991 Murata ..... G10D 3/06 84/293
5,918,299 A * 6/1999 Yui ..... G10D 3/02 84/291
5,952,591 A * 9/1999 Thurman ..... G10D 3/02 84/267
6,329,581 B1 * 12/2001 Negin ..... G10D 1/00 84/267
6,667,431 B1 * 12/2003 Norman ..... G10D 1/08 84/290
6,693,233 B1 * 2/2004 Sewell ..... G10D 1/08 84/267
D536,724 S * 2/2007 Cupit ..... D17/14
7,425,671 B2 * 9/2008 Cupit ..... G10D 1/00 84/173
7,579,534 B1 * 8/2009 Ryan ..... G10D 3/02 84/267
7,687,696 B2 * 3/2010 Fox ..... G10D 3/22 84/290
7,795,513 B2 * 9/2010 Luttwak ..... G10D 1/08 84/267
7,872,185 B1 * 1/2011 Chadwick ..... G10D 1/08 84/293
10,204,602 B2 * 2/2019 Quercetani ..... G10D 3/06
2002/0162442 A1 * 11/2002 Bryan ..... G10D 3/02 84/291
2005/0155480 A1 * 7/2005 Joseph ..... G10D 1/00 84/299
2020/0090631 A1 * 3/2020 Feldman ..... G10D 3/01
2020/0211514 A1 * 7/2020 Johnson ..... G10D 1/08
2020/0251075 A1 * 8/2020 Burch ..... G10D 1/08

* cited by examiner

ACOUSTIC BASS GUITAR

CROSS REFERENCE TO RELATED APPLICATIONS

This application claims the benefit of U.S. Provisional Application No. 62/855,353 filed on May 31, 2019. The above identified patent application is herein incorporated by reference in its entirety to provide continuity of disclosure.

FIELD OF THE INVENTION

The present invention relates to acoustic stringed instruments. More particularly, the present invention provides an acoustic stringed instrument with an upper body that connects to headstock for improved sound characteristics.

BACKGROUND OF THE INVENTION

Most guitars typically include a body, a neck extending upwardly from the body, and a headstock affixed atop the neck. For acoustic bass guitars, it is important that the body be able to resonate and generate a deep, rich sound caused by the thicker strings and the larger body. A classical upright bass is extremely large, bulky, and difficult to maneuver. Acoustic bass guitars can be played in a more comfortable horizontal position and attempt to recreate the richness and sustain provided by the larger upright classical bass. However, typical acoustic bass guitars have the same shape and form as an acoustic guitar. While this allows for a more comfortable and mobile playing position, the sustain and loudness suffers because of it. Further, some individuals do prefer an upright playing position as a personal preference, which a typical acoustic bass guitar does not accommodate. In view of the above concerns, it is desirable to provide an improved acoustic bass guitar with improved loudness capabilities and improved sustain, much like a piano. It is also desirable to provide an improved acoustic bass guitar that can be played in a vertical orientation or a horizontal orientation according to the preference of the musician.

In light of acoustic bass guitars in the known art, it is submitted that the present invention substantially diverges in design elements from the prior art, and consequently it is clear that there is a need in the art for an improvement to existing acoustic bass guitars. In this regard, the present invention substantially fulfills these needs.

SUMMARY OF THE INVENTION

In view of the foregoing disadvantages inherent in the known types of acoustic bass guitars now present in the prior art, the present invention provides an acoustic bass guitar wherein the same can be utilized for providing improved loudness, sustain, and different playing positions for the user.

In an exemplary embodiment, the acoustic bass guitar includes a lower body, a neck extending upwardly from the lower body, and a headstock disposed on an upper end of the neck. The lower body includes a bridge and saddle to support the strings, which are affixed at opposing ends to tuners on the headstock. An upper body that is continuous with the lower body includes a curved extension that extends outwardly from an upper side of the lower body. The upper body curves inwardly toward the upper end of the neck, connecting to the headstock and defining an open area between the neck and the inner sidewall of the upper body. One or more sound holes are disposed on the front face and outer sidewall of the upper body. A retractable stand is configured to selectively extend out of or retract into the lower end of the lower body.

An object of the present invention is to provide an acoustic bass guitar that has an enlarge upper body portion for improving the neck stability, loudness, and sustain of the bass guitar.

Another object of the present invention is to provide an acoustic bass guitar that includes a retractable lower stand, allowing the acoustic bass guitar to be played in a horizontal orientation or in a vertical orientation more akin to a classical upright bass.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
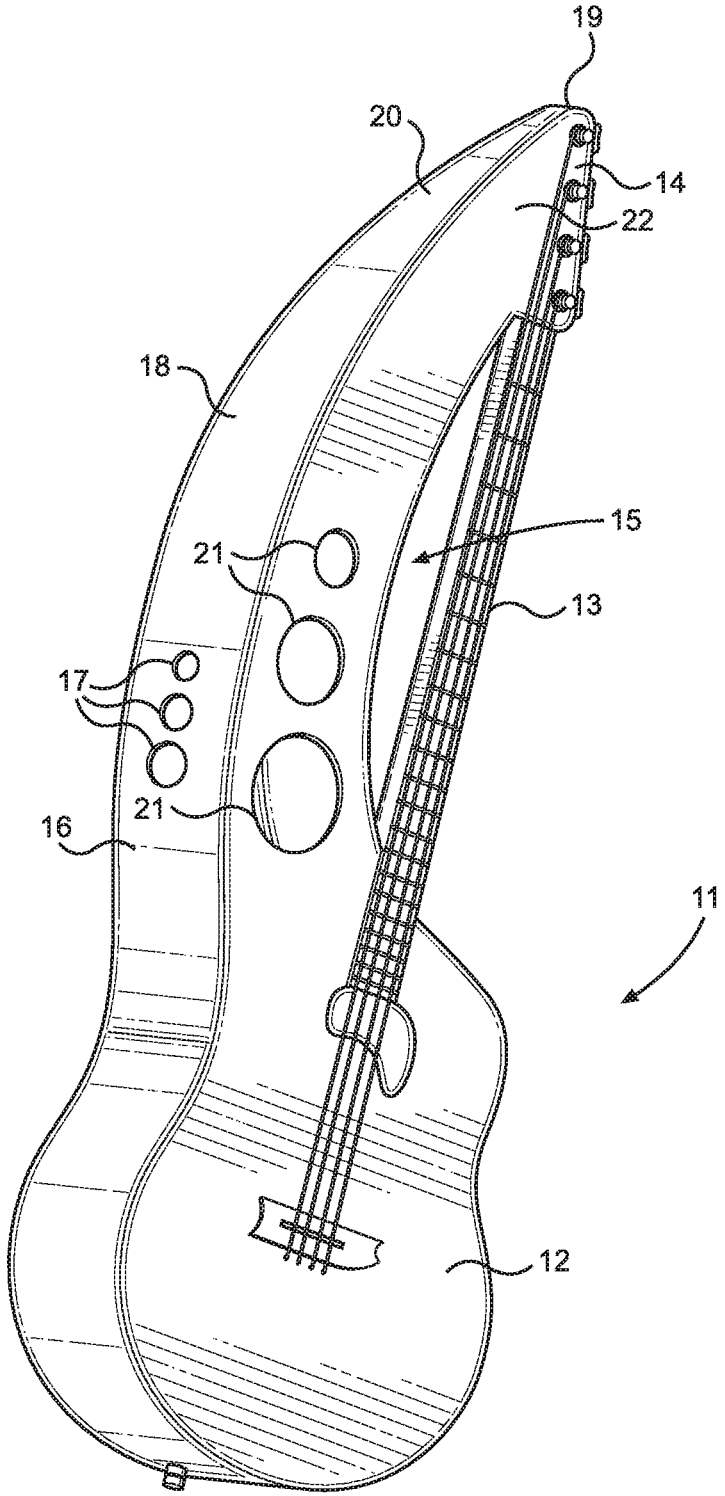
FIG. 1 shows a perspective view of an acoustic bass guitar according to the present invention.

Reference is made herein to the attached drawings. Like reference numerals are used throughout the drawings to depict like or similar elements of the acoustic bass guitar. For the purposes of presenting a brief and clear description of the present invention, the preferred embodiment will be discussed as used for providing additional stability, loudness, sustain, and playing position options for an acoustic bass guitar. The figures are intended for representative purposes only and should not be considered to be limiting in any respect.

Figure 4:
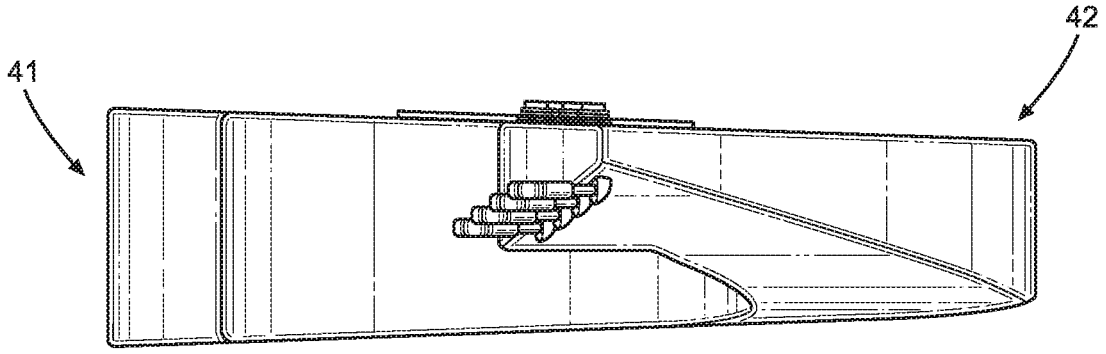
FIG. 4 shows a top plan view of an acoustic bass guitar according to the present invention.

Referring now to FIGS. 1 and 4, there is shown a perspective view of an acoustic bass guitar according to the present invention and a top plan view of an acoustic bass guitar according to the present invention, respectively. The acoustic bass guitar 11 includes a lower body 12, a neck 13 extending upwardly from the lower body 12, and a headstock 14 disposed on the upper end of the neck 13. The lower body 12 can be composed different types of wood or any other suitable materials. In the illustrated embodiment, the lower body 12 includes a dreadnought shape. However, in other embodiments, the lower body 12 may include various cutaways or other different shapes. In the illustrated embodiment, the neck 13 is shown having a fingerboard and frets. However, some embodiments may include no frets disposed on the fingerboard. In the illustrated embodiment, the lower end of the lower body 12 includes a bridge thereon, as well as a saddle configured to support a plurality of strings that are affixed to the bridge at one end and to a plurality of tuners disposed on the headstock 14 at a second opposing end.

An upper body 18 extends upwardly from an upper side of the lower body 12. The upper body 18 forms a curved extension that extends outwardly from the upper side of the lower body 12, and curves back inwardly toward the neck 13, terminating at the upper end 19 of the headstock 14. The curvature of the upper body 18 defines an open area 15 between the neck 13 and an inner sidewall of the upper body 18. In the shown embodiment, the upper body 18 is continuous or monolithic with the lower body 12. Additionally, in the shown embodiment, the upper body 18 is continuous or monolithic with the upper end 19 of the headstock 14. The continuous, monolithic construction improves sound quality, as well as sustain and durability. Further, the sidewall 16 of the upper body 18 tapers inwardly from a lower end to an upper end 20 thereof, such that a width of a lower end of the upper body 18 is greater than a width of an upper end 19 of the upper body 18. Additionally, as more clearly shown in FIG. 4, the lower body 12 can include a similar tapered construction, such that an upper side 41 of the lower body 18 includes a width that is less than a width of the lower side 42 of the lower body 18, defining a generally trapezoidal cross—sectional area.

The acoustic bass guitar 11 may include multiple sound holes for improving the sound quality and adding sustain. In the shown embodiment, the acoustic bass guitar 11 includes a first grouping of sound holes 21 disposed on an upper face of the upper body 12, and a second grouping of sound holes 17 disposed on an outer sidewall 16 of the upper body 18. The sound holes act to increase loudness and sustain. In the shown embodiment, at least one of the sound holes 21 align with the twelfth fret. This positioning helps to further improve loudness and sustain, particularly when playing natural harmonics or other generally quieter notes. Other embodiments of the present invention may include different numbers and positionings of sound holes, and still other embodiments of the present invention may include no sound holes.

Figure 2:
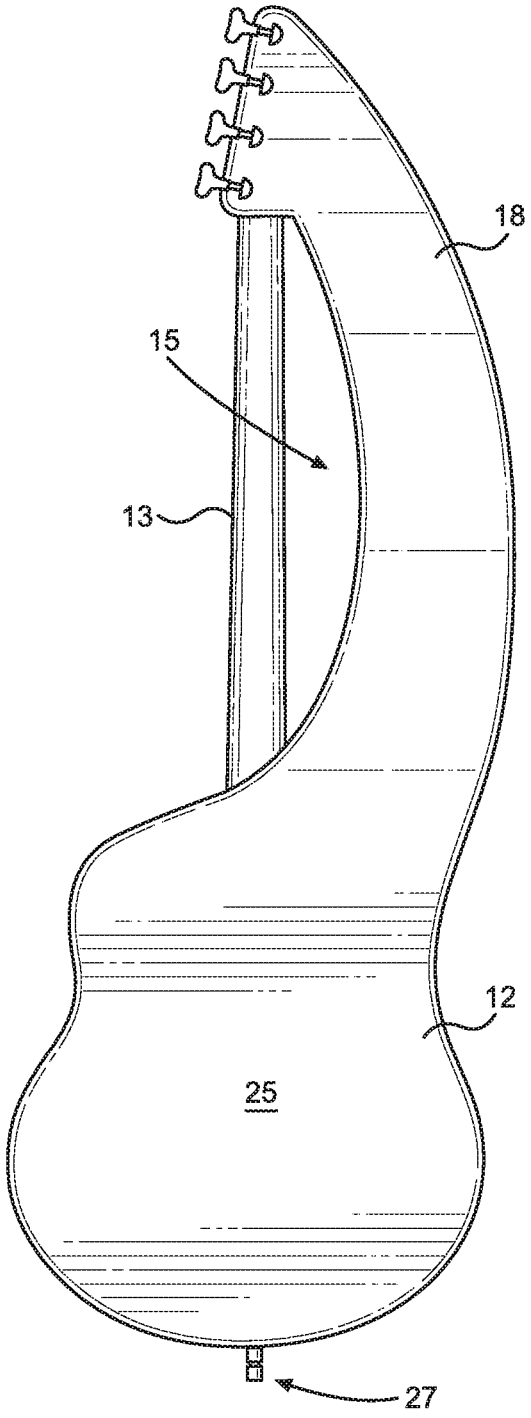
FIG. 2 shows a rear elevation view of an acoustic bass guitar according to the present invention with the lower stand retracted.
Figure 3:
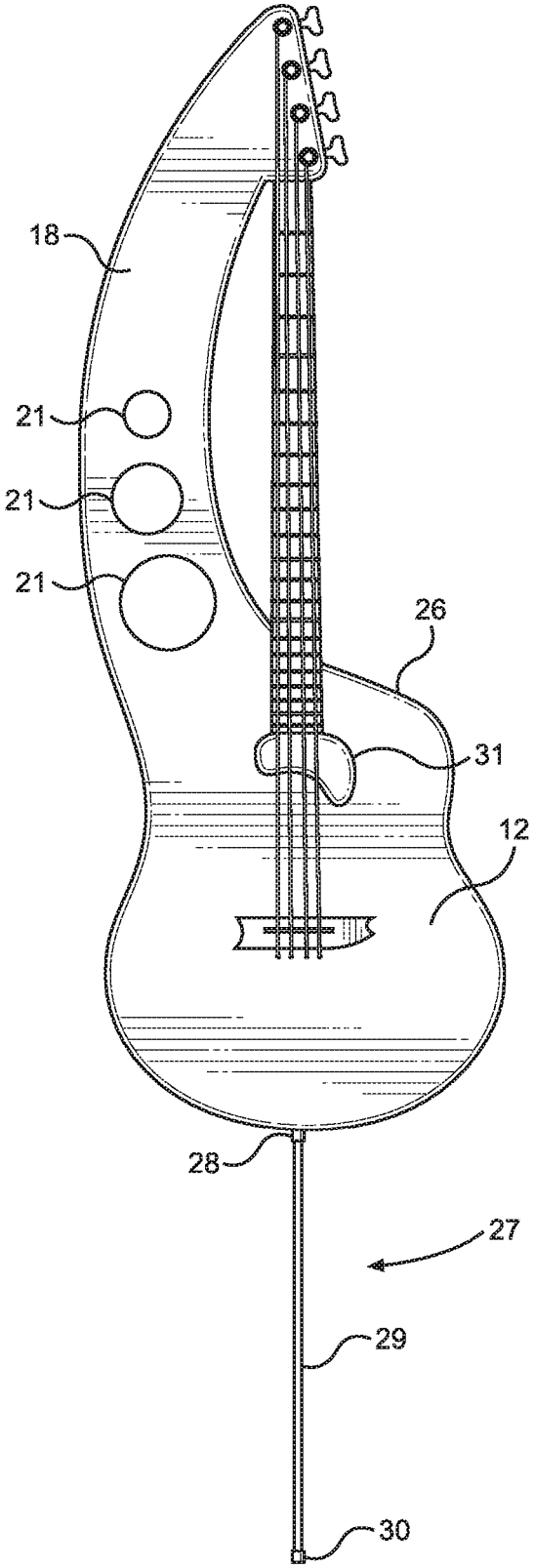
FIG. 3 shows a front elevation view of an acoustic bass guitar according to the present invention with the lower stand extended.

Referring now to FIGS. 2 and 3, there is shown a rear elevation view of an acoustic bass guitar according to the present invention with the lower stand retracted and a front elevation view of an acoustic bass guitar according to the present invention with the lower stand extended, respectively. In the shown embodiment, the acoustic bass guitar includes a stand 27 which allows the acoustic bass guitar to be played in an upright orientation as desired. The stand 27 includes an elongated shaft 29 that extends outwardly from an aperture 28 on a lower end of the lower body 12. The shaft 29 can be selectively locked in a retracted position for storage, as shown in FIG. 2, when playing the acoustic bass guitar in a horizontal orientation. Correspondingly, the shaft 29 can be selectively locked in an extended position for supporting the acoustic bass guitar in an upright orientation, as shown in FIG. 3. A base 30 of the stand 27 contacts the ground or other similar support surface. The base 30 can include a rubber cap or similar materials for preventing unwanted slippage. Additionally, the aperture 28 includes a tightening or locking mechanism, such as a threaded nut for example, which can be fastened to secure the shaft 29 at a desired length, or unfastened to permit adjustment of the positioning of the shaft 29.

The acoustic bass guitar may also include a pickguard 31 affixed to a front face of the body 12. In the shown embodiment, the pickguard 31 contacts the lower end of the fingerboard portion of the neck 13. The pickguard 31 further includes a curved portion that extends away from the upper end of the lower body 12, curving downwardly toward the lower end of the lower body 12. The positioning and shape of the pickguard 31 is optimized such that the pickguard 31 protects the lower body 12 where the user strikes the strings, whether playing in the upright or horizontal orientation.

In operation the user may extend the stand 27 if they wish to play the acoustic bass guitar in an upright orientation. The stand 27 can be adjusted to a desired height for the comfort of the user, depending upon the relative heights of the user and the acoustic bass guitar. Likewise, the user may retract the stand 27 if they would rather play the bass guitar in a horizontal orientation. In this way, the acoustic bass guitar can be played in a variety of positions, while the combination of the upper body and its multiple sound holes provide greatly enhanced loudness, sustain, and sound quality.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. While the present invention contemplates an acoustic bass guitar, it should be understood that the structural and functional features of the acoustic bass guitar may be applied to similar stringed instruments of varying size, such as a smaller acoustic guitar or ukulele, for example, and still fall within the scope of the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stringed instrument, comprising:

a lower body;

a neck extending upwardly from the lower body;

a headstock disposed on an upper end of the neck;

an upper body that is continuous with the lower body, the upper body comprising a curved extension that extends outwardly from an upper side of the lower body and curves back inwardly toward the upper end of the neck, wherein the upper body terminates at the headstock;

wherein the upper body defines an open area between the neck and an inner sidewall of the upper body;

wherein each of an outer sidewall and the inner sidewall of the upper body taper inwardly from a lower end to an upper end thereof, such that a width of a lower end of the upper body is greater than a width of an upper end of the upper body;

wherein the upper side of the lower body includes a width that is less than a width of the lower end of the lower body, defining a trapezoidal cross-sectional area.

2. The stringed instrument of claim 1, further comprising a fingerboard disposed on the neck.

3. The stringed instrument of claim 1, further comprising a pickguard disposed on the lower body.

4. The stringed instrument of claim 3, further comprising a plurality of frets disposed on the fingerboard.

5. The stringed instrument of claim 1, further comprising a bridge disposed on a lower end of the lower body.

6. The stringed instrument of claim 5, further comprising a saddle configured to support a plurality of strings that are affixed to the bridge at one end and to a plurality of tuners disposed on the head stock at a second opposing end.

7. The stringed instrument of claim 1, further comprising a first grouping of one or more sound holes disposed on an upper face of the upper body.

8. The stringed instrument of claim 7, further comprising a second grouping of one or more sound holes disposed on an outer sidewall of the upper body.

9. The stringed instrument of claim 8, wherein either the first grouping of one or more sound holes or second grouping of one or more sound holes includes at least one sound hole that aligns with a twelfth fret of the neck.

10. A stringed instrument, comprising:

a lower body;

a neck extending upwardly from the lower body;

a headstock disposed on an upper end of the neck;

an upper body that is continuous with the lower body, the upper body comprising a curved extension that extends outwardly from an upper side of the lower body and curves back inwardly toward the upper end of the neck, wherein the upper body terminates at the headstock;

wherein the upper body defines an open area between the neck and an inner sidewall of the upper body;

wherein each of an outer sidewall and the inner sidewall of the upper body taper inwardly from a lower end to an upper end thereof, such that a width of a lower end of the upper body is greater than a width of an upper end of the upper body;

wherein the upper side of the lower body includes a width that is less than a width of the lower end of the lower body, defining a trapezoidal cross-sectional area; and a retractable stand affixed to a lower end of the lower body, wherein the stand comprises a shaft configured to be adjustable between a retracted position and an extended position.

11. The stringed instrument of claim 10, further comprising a fingerboard disposed on the neck.

12. The stringed instrument of claim 10, further comprising a pickguard disposed on the lower body.

13. The stringed instrument of claim 12, further comprising a plurality of frets disposed on the fingerboard.

14. The stringed instrument of claim 10, further comprising a bridge disposed on a lower end of the lower body.

15. The stringed instrument of claim 14, further comprising a saddle configured to support a plurality of strings that are affixed to the bridge at one end and to a plurality of tuners disposed on the head stock at a second opposing end.

16. The stringed instrument of claim 10, further comprising a first grouping of one or more sound holes disposed on an upper face of the upper body.

17. The stringed instrument of claim 16, further comprising a second grouping of one or more sound holes disposed on an outer sidewall of the upper body.

18. The stringed instrument of claim 17, wherein either the first grouping of one or more sound holes or second grouping of one or more sound holes includes at least one sound hole that aligns with a twelfth fret of the neck.

* * * * *